US007887253B2

(12) United States Patent
Lenz et al.

(10) Patent No.: US 7,887,253 B2
(45) Date of Patent: Feb. 15, 2011

(54) JOLTING DEVICE

(75) Inventors: Martin Lenz, Grossmaischeld (DE); Günter Hähn, Königswinter (DE)

(73) Assignee: Wirtgen GmbH (DE)

( * ) Notice: Subject to any disclaimer, the term of this patent is extended or adjusted under 35 U.S.C. 154(b) by 176 days.

(21) Appl. No.: 12/342,313

(22) Filed: Dec. 23, 2008

(65) Prior Publication Data

US 2010/0158610 A1 Jun. 24, 2010

(51) Int. Cl.
*E01C 19/38* (2006.01)

(52) U.S. Cl. ..... 404/113; 404/115

(58) Field of Classification Search ..... 404/92, 404/101, 102, 115, 116, 113; 366/128
See application file for complete search history.

(56) References Cited

U.S. PATENT DOCUMENTS

| | | | | |
|---|---|---|---|---|
| 2,261,659 | A | 11/1941 | Pierce | |
| 3,098,415 | A * | 7/1963 | Guntert | 404/102 |
| 3,446,907 | A * | 5/1969 | Bouche | 174/42 |
| 3,486,568 | A * | 12/1969 | Westerlund et al. | 173/31 |
| 3,802,791 | A * | 4/1974 | Uebel et al. | 404/133.1 |
| 4,011,347 | A * | 3/1977 | Griffith | 426/124 |
| 4,017,060 | A * | 4/1977 | Brander et al. | 366/115 |
| 4,259,541 | A * | 3/1981 | Bouche | 174/42 |
| 5,220,845 | A * | 6/1993 | Anderson | 74/61 |
| 5,310,167 | A | 5/1994 | Noll, Jr. | |
| 5,529,435 | A | 6/1996 | Sonntag et al. | |
| 6,213,673 | B1 * | 4/2001 | Jungwirth et al. | 403/120 |
| 6,213,681 | B1 * | 4/2001 | Sick et al. | 404/133.05 |
| 6,237,901 | B1 | 5/2001 | Bianchi | |
| 6,267,532 | B1 * | 7/2001 | Persson | 404/133.1 |
| 2004/0097881 | A1 * | 5/2004 | Brustad et al. | 604/164.07 |

FOREIGN PATENT DOCUMENTS

| | | | |
|---|---|---|---|
| DE | G8705586.4 | U1 | 6/1988 |
| DE | 10 2004 031 147 | A1 | 1/2006 |
| EP | 0295585 | A1 | 12/1988 |
| GB | 576424 | | 4/1946 |

* cited by examiner

*Primary Examiner*—Raymond W Addie
(74) *Attorney, Agent, or Firm*—Waddey & Patterson, P.C.; Lucian Wayne Beavers

(57) ABSTRACT

In a jolting device (1) for a construction machine, particularly for a slip-form paver, comprising a housing (18), a vibration generator (19) arranged in the housing (18), and a fastening means (10) including at least one coil spring (8) having a plurality of spring windings, with said fastening means (10) being operative for fastening the housing (18) to the construction machine, it is provided that the interspaces between the spring windings of said at least one coil spring (8) are closed or at least partially filled towards the interior by an elastic element (22).

19 Claims, 6 Drawing Sheets

JOLTING DEVICE

BACKGROUND OF THE INVENTION

The present invention relates to a jolting device for a construction machine, as well as a self-propelling construction machine, particularly a slip-form paver.

Jolting devices of the above type, when used in slip-form pavers, are provided for the liquefying and condensing of concrete. Slip-form pavers are put to use in the construction of roads, channels and airfields. They are suited for producing road tops, water gutters, curb profiles, and safety guardwalls for concrete roads.

Presently known jolting devices are normally used in construction machines, particularly in slip-form pavers. Such a jolting device comprises a housing, a vibration generator arranged in the housing, and a fastening means. With the aid of the fastening means, the housing of the jolting device will be fastened to the construction machine, the fastening means being provided with at least one spring, particularly a coil spring which largely or fully prevents the transmission of vibrations of the vibration generator to the construction machine, thus decoupling the jolting device from the machine frame.

In jolting devices, it is indeed a widespread practice that, during operation, the fastening means is at least partially immersed into the construction material. In presently known jolting devices, this entails the disadvantage that granules of the concrete additives may happen to adhere between the springs. These granules will be increasingly surrounded by concrete until the springs, under the effect of the concrete caked to them, tend to become immobile and cause the elastic qualities of the springs to deteriorate. As a consequence, the above mentioned decoupling effect will finally vanish so that the vibrations of the jolting device can be transmitted to the machine frame. This may result in damage to the fastening means, the machine frame and particularly the jolting device.

In view of the above, it is an object of the present invention to improve a jolting device of the initially mentioned type to the effect that the elastic qualities of the jolting device will not deteriorate even after a protracted operational period, no damage will be caused to the machine frame by the vibrations and the useful life of the jolting device will be increased.

According to the invention, the above object is achieved.

SUMMARY OF THE INVENTION

The invention advantageously provides that, in a jolting device of the above type, the interspaces between the spring windings of the at least one coil spring are closed or filled toward the inside by means of an elastic element. The elastic qualities of the at least one coil spring are, together with those of the elastic element, adapted to the vibration of the vibration generator in such a manner that a transfer of vibrations of the vibration generator to the machine frame is largely or fully prevented. The elastic element can comprise an elastic plastic composition such as e.g. rubber, elastomeric material or the like.

The above embodiment has the advantage that no construction material is allowed to adhere in or on the coil springs. Thus, the elastic qualities will be maintained even if the fastening means remains immersed in the construction material for a longer period.

The elastic element can be a shaped component which is inserted into the coil spring. The shaped component can be adapted to the inner contour of the coil spring, thus allowing it to be rotated into the coil spring. This offers the advantage that, in case that the arrangement is to be disassembled, the shaped component can be removed by rotating it out of the coil spring again.

By way of alternative, the shaped component can have a cylindrical shape, with the diameter of the shaped component being equal to or slightly smaller than the inner diameter of the coil spring.

The ends of the coil spring can be connected to fastening plates arranged on the end sides. The shaped component can comprise a projection on one or both of its end sides, said projection engaging either a recess formed in the fastening plate and adapted to the projection, or a hexagon-socket type screw. The projections of the shaped components can consist of insertion parts which will be added to the shaped component during manufacture of the shaped component.

The at least one coil spring can be enclosed on its outer side by a layer-type elastic element provided to close the interspaces between the spring windings towards the inside. This layer-shaped elastic element can be a shrinkage film or a bellows. Also, the layer-shaped elastic element arranged on the outer side of the coil spring can be used in combination with the cylindrical shaped component.

According to a further embodiment, the coil spring can be completely surrounded by the elastic element, substantially with the exception of the fastening means. The coil spring can have the elastic material cast there-around, with the spring windings of the coil spring being fully enclosed.

Internally of the at least one coil spring, a hollow space can be arranged, extending along the axis of the coil spring and being open on both end sides of the coil spring.

Said hollow space offers the advantage that the coil springs can be fastened to the fastening plates in an easier manner.

According to a further embodiment, the fastening means can comprise more than one coil spring, preferably four of them.

The fastening plate, particularly the lower fastening plate, can be provided with at least one opening between the sites where the coil springs are attached to the respective fastening plate. Said at least one opening can at least be sized large enough so that an object which has passed between two adjacent coil springs and has entered the interior space between the coil springs, may leave the inner space again via said opening.

In this manner, advantageously, objects such as e.g. stones which happen to pass between the coil springs, can be rinsed out again via said openings.

The preferably two coil springs can be enclosed by an elastic element to form an integral unit therewith, and the coil springs preferably have the elastic element cast therearound. In this manner, the coil springs and the elastic element will form a one-pieced spring pack which can be fastened to the fastening plates as a unitary structure.

The above described jolting device can be a component of a self-propellant construction machine, particularly a slip-form paver.

Embodiments of the invention will be explained in greater detail hereunder with reference to the accompanying drawings in which the invention is schematically illustrated.

DETAILED DESCRIPTION OF A PREFERRED EMBODIMENT

Figure 1:
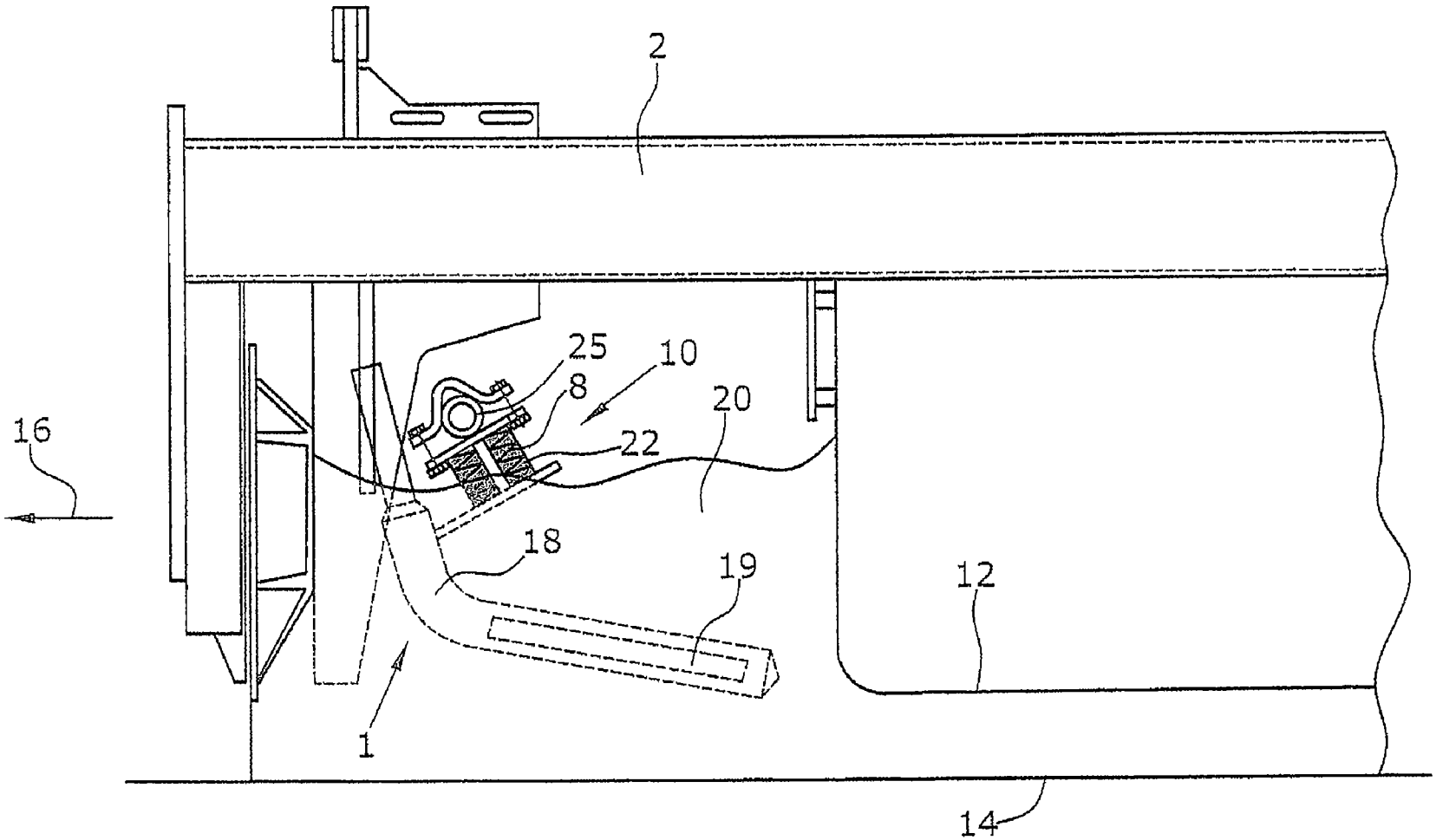
FIG. 1 is a lateral view of a portion of a slip-form paver.

FIG. 1 schematically illustrates a portion of a slip-form paver. The slip-form paver comprises a pressure plate 12 extending across the width of the slip-form paver, arranged parallel to the ground 14 and transverse to the travel direction 16. Arranged on the lateral ends of pressure plate 12 is a respective height-adjustable side wall (not shown). A plurality of jolting devices 1 are arranged upstream of pressure plate 12 when seen in the travel direction 16. These jolting devices 1 are arranged in series transverse to the travel direction. The jolting device 1 is immersed in construction material consisting of concrete 20 or a concrete mixture. Each jolting device 1 comprises a housing 18, a vibration generator 19 arranged in housing 18, and a fastening means 10. Vibration generator 19 is operative to perform vibrations while being driven, for instance, by an electric drive means in connection with an imbalance mass. Said imbalance mass can rotate e.g. at 12,000 rpm. The vibrational amplitude in the process is very low, for instance ±0.4 mm at the free end of the jolting device. Thereby, the construction material will be liquefied and then be brought into the desired shape by means of pressure plate 12. The jolting devices 1 will liquefy the construction material with an effective range of a diameter of about 75 cm around housing 18. The jolting devices 1 are arranged in such a configuration that the vibrations of adjacent jolting devices overlap each other. The fastening means 10 serves for fastening the housing 18 of jolting device 1 to a tube 25 attached to the machine frame 2 of the construction machine. Tube 25 can be adjusted in height relative to machine frame 2 by means of a piston/cylinder unit. Further, tube 25 can be extended in width for thus adapting it to the working width. By way of alternative, fastening means 10 can be attached to pressure plate 12. To ensure that the vibrations produced by vibration generator 19 are not transmitted to the machine frame 2 of the construction machine, fastening means 10 is provided with a plurality of coil springs 8 having a soft spring characteristic. The coil springs 8 respectively comprise a plurality of spring windings. The elastic properties of the coil springs 8 are adapted to the vibrations of the vibration generator 19 so that a transmission of vibrations of vibration generator 19 to the construction machine is largely or fully prevented. During operation, the fastening means 10 with the coil springs 8 can be partially immersed into the concrete 20.

In the embodiment of the invention shown in FIG. 1, elastic elements 22 which respectively consist of shaped components, are placed in the coil springs 8. The shaped components are adapted to the inner contour of the respective coil spring 8, with the result that the interspaces between the spring windings are closed toward the inside. The elastic properties of the elastic elements are adapted to those of the coil springs 8 in such a manner that the elastic and damping properties of fastening means 10 will not or only insubstantially deteriorate; thus, a transmission of vibrations of the jolting device 1 to the machine frame 2 of the construction machine will continue to be largely or fully prevented. Since the interspaces between the spring windings of the coil springs 8 are filled, the coil springs 8 are not susceptible anymore to an adherence of granules, stones or the like on which the concrete 20 could agglomerate.

Figure 2:
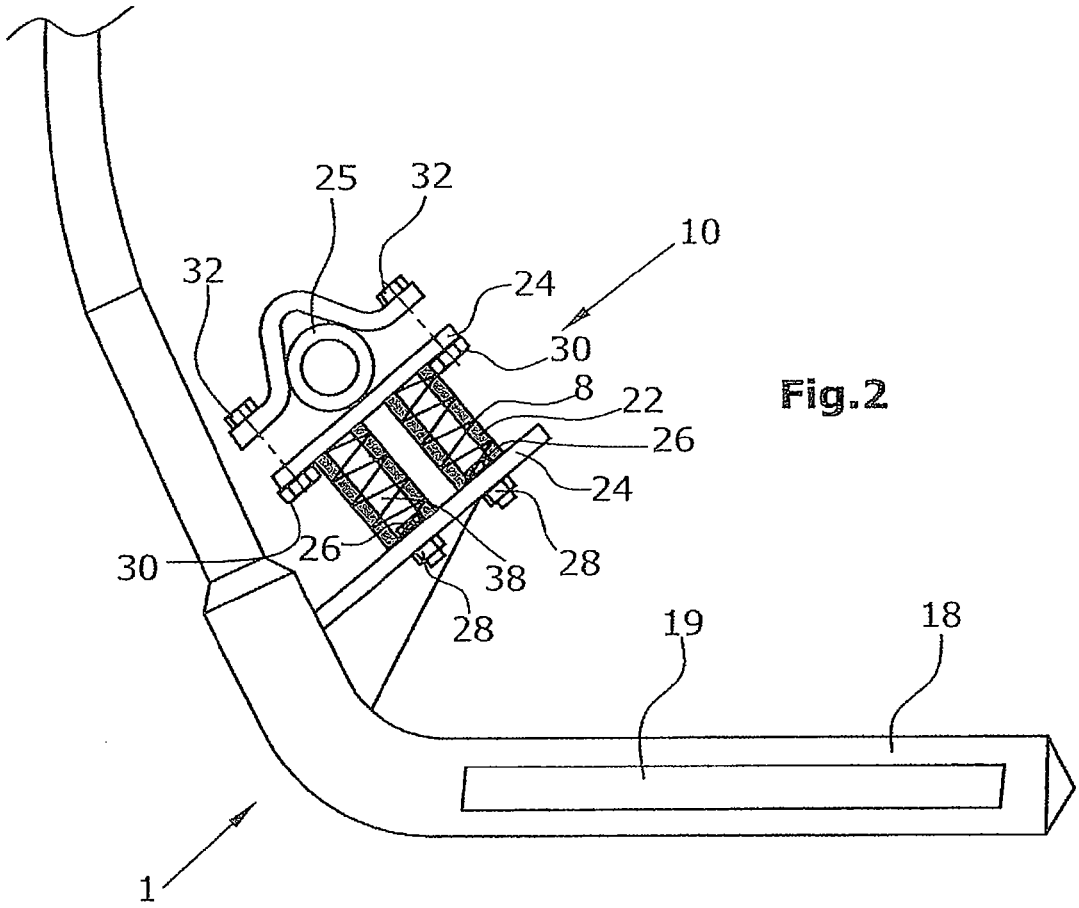
FIG. 2 is a lateral view of a jolting device with a fastening means of a slip-form paver.

In FIG. 2, a further embodiment is shown. Each coil spring 8 has an elastic element cast 22 therearound or is surrounded by an elastic element, with the elastic element fully enclosing the spring windings of the coil spring 8. Arranged in the interior of each coil spring 8 is a hollow space 38, extending along the respective coil spring axis and being open on both end sides of the respective coil spring 8. The coil springs 8 are fastened to the lower fastening plate 24 by means of screws 26 and nuts 28. The last spring winding of coil spring 8 has a smaller diameter than the other spring windings of coil spring 8, and said last spring winding is clamped between the head of a screw 26 and the lower fastening plate 24. The respective screws 26 are attached by means of nuts 28 to the underside of the lower fastening plate 24. The attachment of the coil springs 8 to the upper fastening plate 24 is effected e.g. in that the respective last spring winding is wound into the opposite direction so that this last spring winding forms an eyelet-like opening. This last spring winding is clamped between the head of a screw 30 and the upper fastening plate 24. The screw 30 is attached to the upper side of the second fastening plate 26, again by means of a nut 32.

Figure 3A:
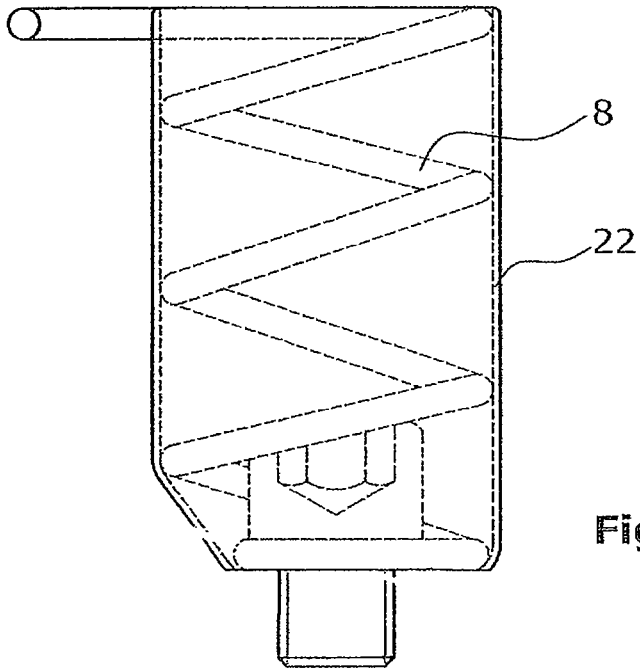
FIG. 3*a* is a lateral view of a coil spring with an elastic film.

FIG. 3*a* illustrates a coil spring 8. The interspaces between the spring windings of coil spring 8 are closed with the aid of a tubular elastic element or shaped component 22. The tubular elastic element 22 can be made of an elastic substance or a film having a thickness of up to several millimeters. The tubular elastic element 22 can be formed e.g. as a shrinkage hose covering the outer side of coil spring 8. By way of alternative, use could be made of a bellows. In combination with said shrinkage hose or the bellows, an additional cylindrical elastic shaped component 22 could be used in the interior of coil spring 8.

Figure 3B:
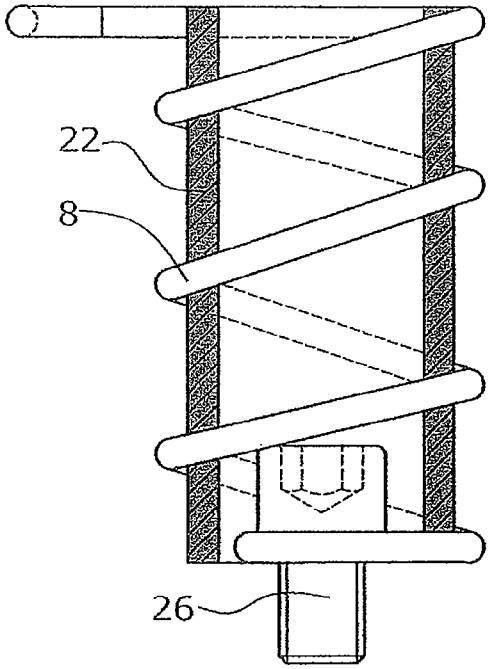
FIG. 3*b* is a lateral view of a coil spring with an inner shell.
Figure 3C:
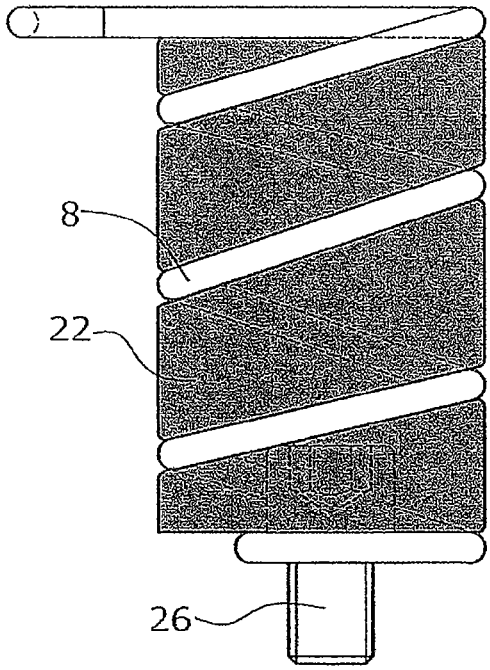
FIG. 3*c* is a lateral view of a coil spring with a shaped component.
Figure 3D:
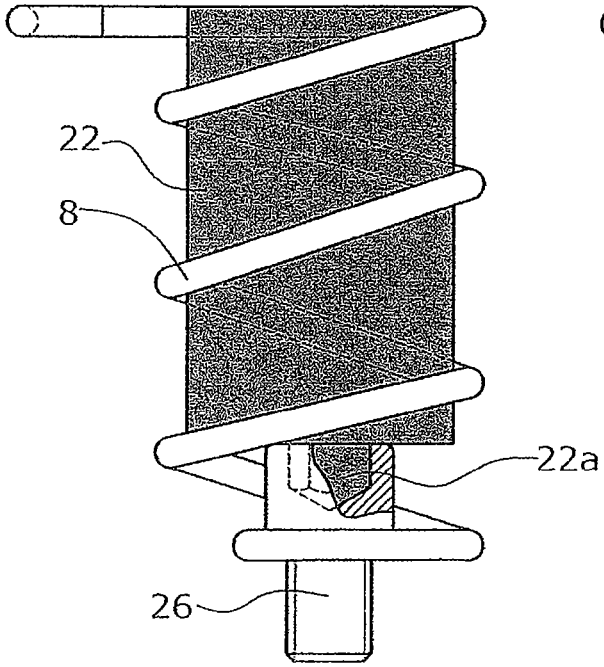
FIG. 3*d* is a lateral view of a coil spring with a cylindrical shaped component.

In FIGS. 3*b*-3*f*, alternative embodiments of the elastic element 22 are illustrated. FIG. 3*b* shows an inner shell having an outer diameter equal to or slightly smaller than the inner diameter of coil spring 8. FIG. 3*c* shows a coil spring 8 provided with a shaped component. Said shaped component is adapted to the inner contour of coil spring 8 and is formed with a recess for accommodating the head of screw 26. This embodiment has already been explained in greater detail in the description of FIG. 1. FIG. 3*d* shows a cylindrical shaped component having an outer diameter equal to or slightly smaller than the inner diameter of coil spring 8. Said shaped component comprises a projection 22*a* adapted to the hexagon socket of the screw head and projecting thereinto. Alternatively, the shaped component of FIG. 3*c* can have no recess and the shaped component of FIG. 3*d* can have no projection. In this case, the shaped components would be arranged in abutment on the respective screw head of screw 26.

Figure 3E:
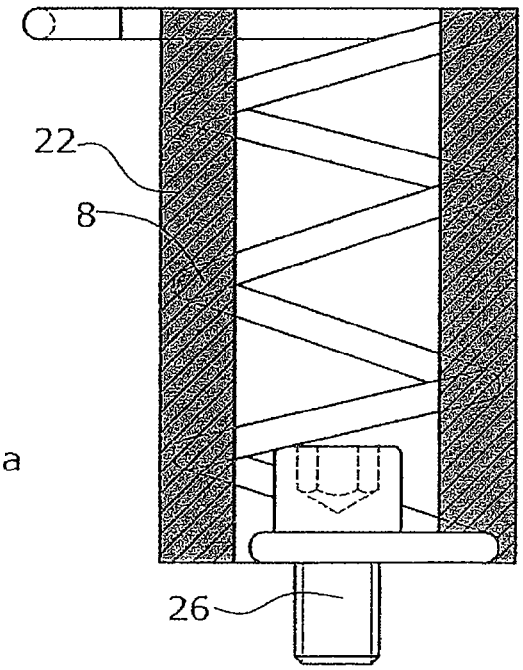
FIG. 3*e* is a lateral view of a coil spring with material cast therearound.
Figure 3F:
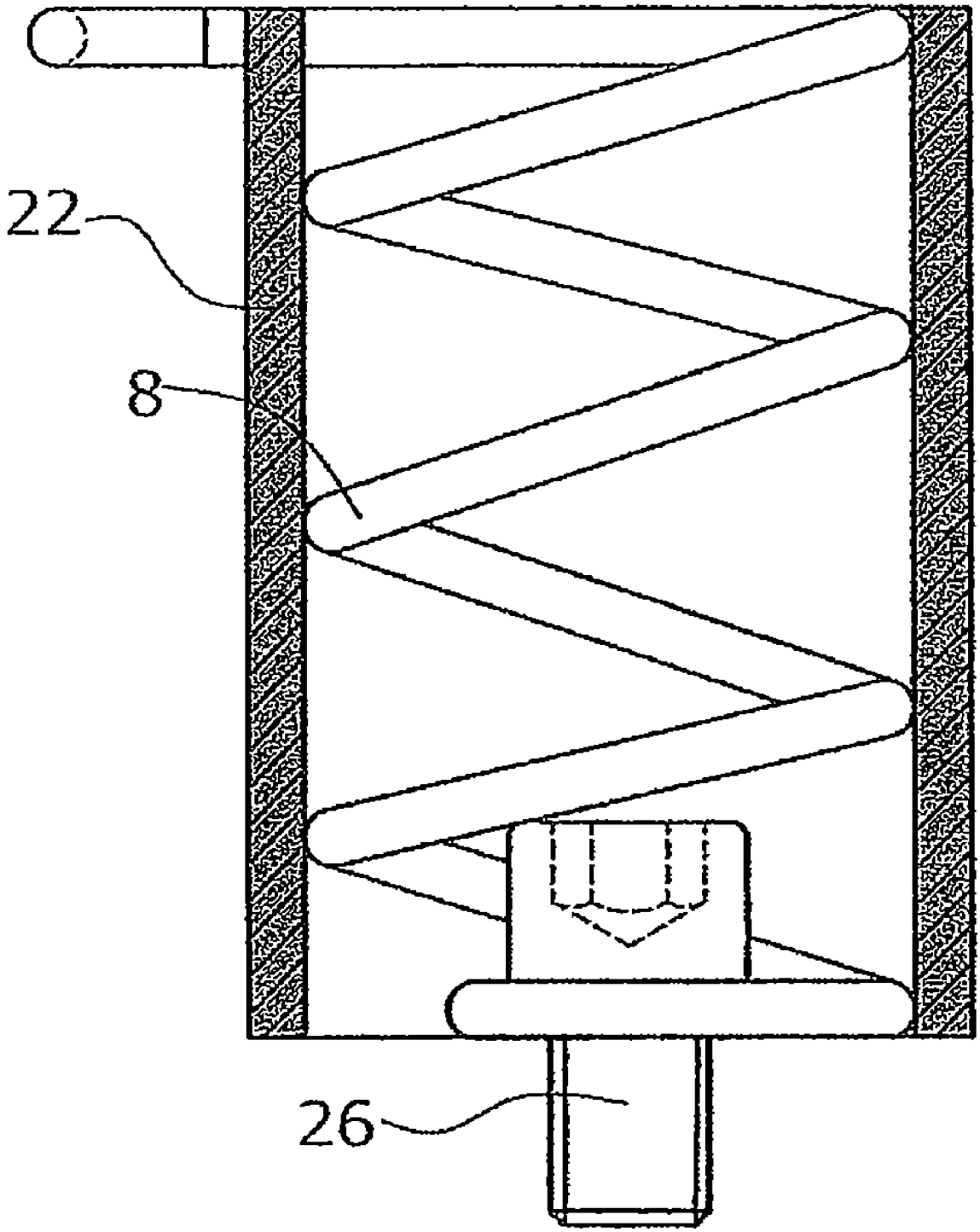
FIG. 3*f* is a lateral view of a coil spring with an outer shell.

FIG. 3*e* shows a coil spring 8 wherein the spring windings have an elastic element 22 cast therearound. This embodiment has already been explained in greater detail in the description of FIG. 2. FIG. 3*f* shows a coil spring 8 enclosed by an outer shell. Said outer shell has an inner diameter equal to or slightly larger than the outer diameter of coil spring 8.

Figure 4:
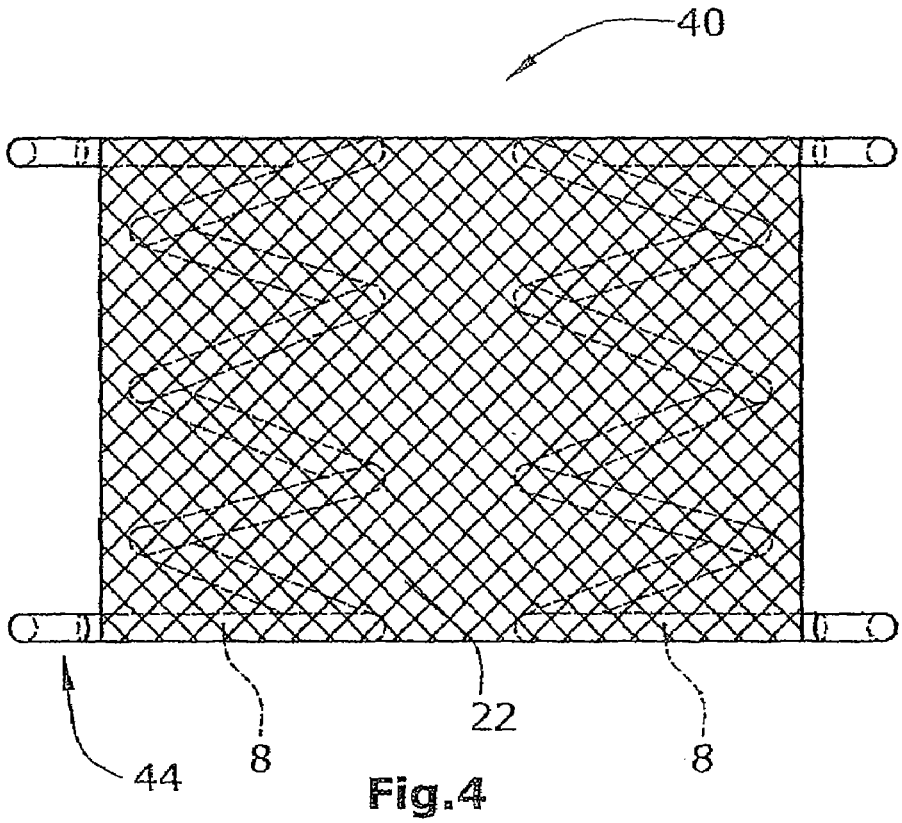
FIG. 4 is a lateral view of a coil spring pack with a fastening means.
Figure 5:
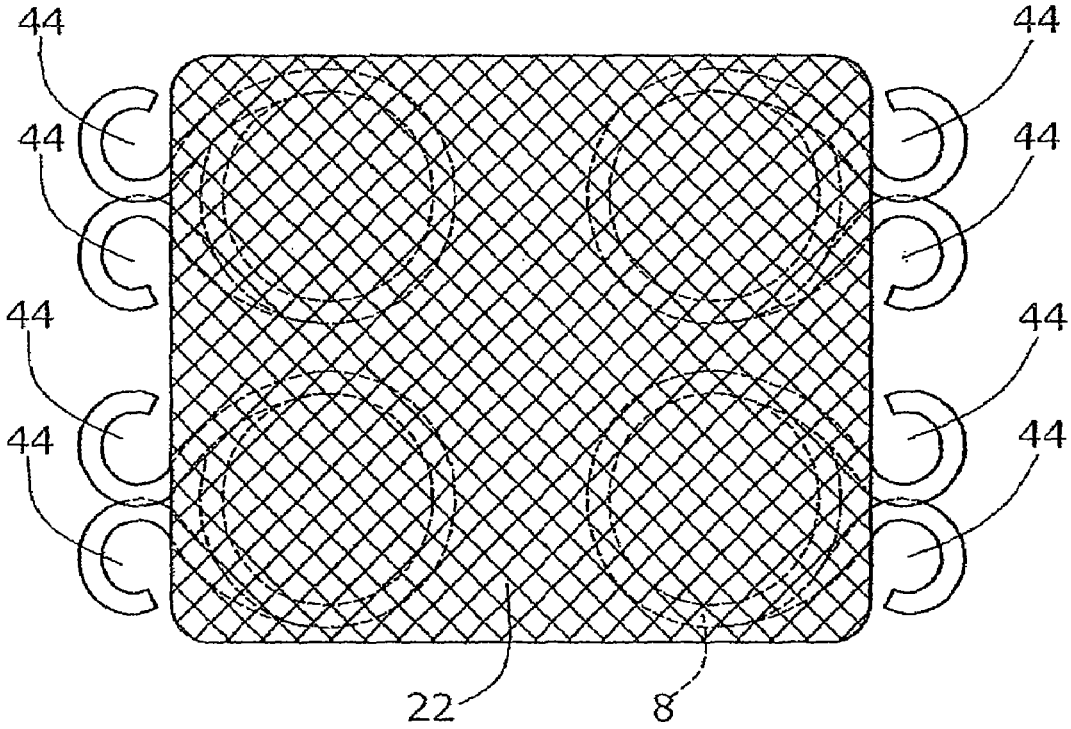
FIG. 5 is a plan view of the coil spring pack illustrated in FIG. 4.

FIG. 4 and FIG. 5 are a lateral view and respectively a plan view of a spring pack 40 consisting of four coil springs 8, the latter having an elastic element 22 cast therearound. For fastening said spring pack 40 to the fastening plates, the spring windings on the respective ends of the coil springs 8 have been turned into the opposite direction, thus forming eyelet-like openings 44. These eyelet-like openings 44 are arranged outside the elastic material 22. Use is made of screws in order to clamp these eyelet-like final spring windings between the respective screw heads and the respective adjacent fastening plate 24. On the respective other side of the fastening plate 24 and respectively of the second fastening plate 26, the screws are pulled tight by means of nuts.

Figure 6:
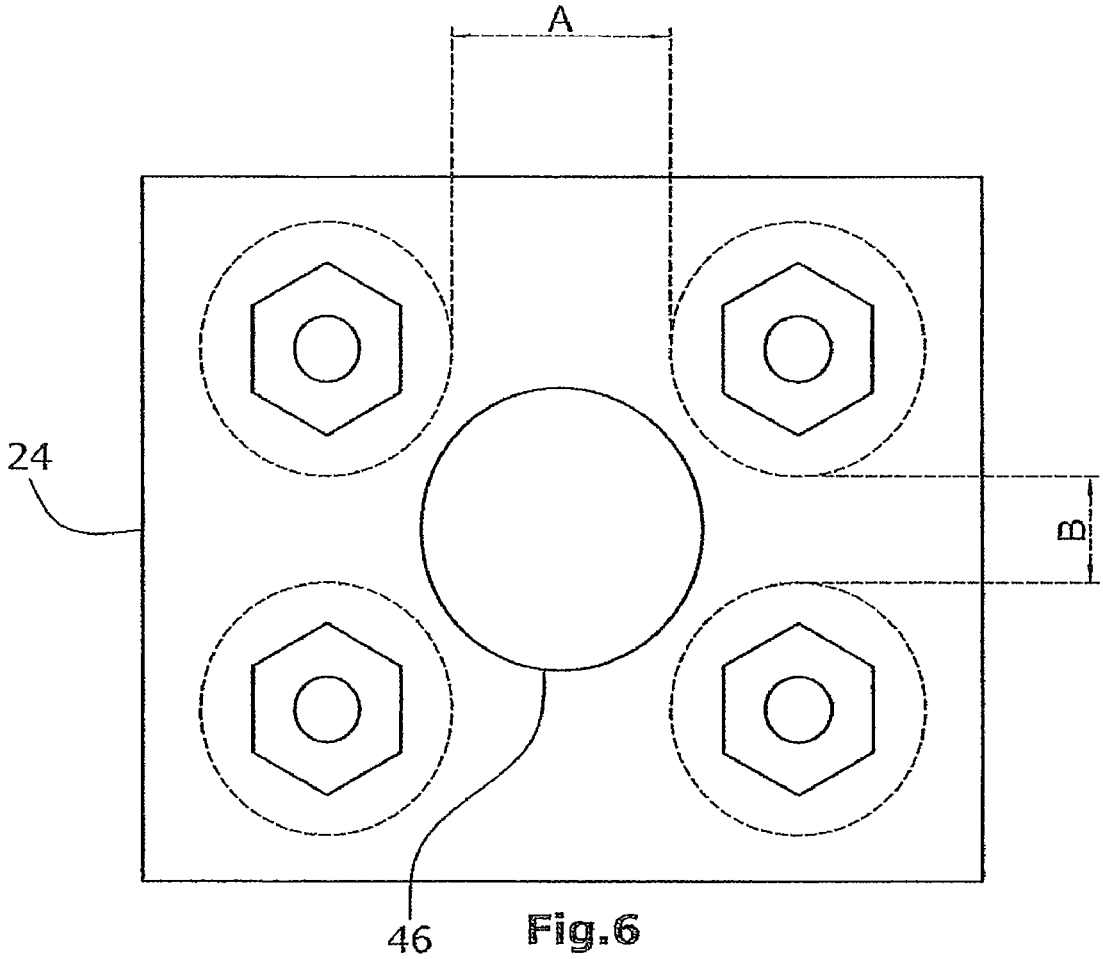
FIG. 6 is a plan view of a fastening plate of the fastening means.

FIG. 6 is a view of the lower bottom plate 24 of FIG. 1 as seen from below. Said lower bottom plate 24 comprises an opening 46 whose diameter is larger than the distance A,B between two adjacent coil springs 8. Therefore, granules which, passing between the coil springs 8, happened to intrude into the interior space between the coil springs 8, can be washed out again via the opening 46.

Although the invention has been described and illustrated with reference to specific illustrative embodiments thereof, it is not intended that the invention be limited to those illustrative embodiments. Those skilled in the art will recognize that variations and modifications can be made without departing from the true scope of the invention as defined by the claims that follow. It is therefore intended to include within the invention all such variations and modifications as fall within the scope of the appended claims and equivalents thereof.

The invention claimed is:

1. A jolting device for a construction machine, comprising:

a housing;

a vibration generator arranged in the housing; and a fastening assembly for fastening the housing to the construction machine, the fastening assembly including:

at least one coil spring having a plurality of spring windings with interspaces between the spring windings and an interior defined within the coil spring; and an elastic element closing the interspaces or at least partially filling the interior of the coil spring.

2. The jolting device according to claim 1, wherein the elastic properties of the at least one coil spring together with the elastic element are such that a transfer of vibrations of the vibration generator to a frame of the construction machine is largely or fully prevented.

3. The jolting device according to claim 1, wherein the elastic element is made of rubber.

4. The jolting device according to claim 1, wherein the elastic element is a shaped component inserted into the coil spring.

5. The jolting device according to claim 4, wherein said shaped component conforms to an inner contour of the coil spring.

6. The jolting device according to claim 4, wherein said shaped component has a cylindrical shape, the diameter of the shaped component being equal to or slightly smaller than an inner diameter of the coil spring.

7. The jolting device according to claim 4, wherein ends of the coil spring are connected to end-side fastening plates and wherein the shaped component is provided with at least one end projection engaging a recess receiving said projection, the recess being defined in one of the fastening plates or in a fastener attached to one of the fastening plates.

8. The jolting device according to claim 1, wherein the elastic element has a tubular shape, the elastic element enclosing an outer side of at least one coil spring and closing the interspaces between the spring windings.

9. The jolting device according to claim 8, wherein the elastic element is a shrinkage hose.

10. The jolting device according to claim 8, wherein the elastic element is a bellows.

11. The jolting device according to claim 1, wherein the at least one coil spring is substantially fully surrounded by the elastic element.

12. The jolting device according to claim 11, wherein the at least one coil spring has an elastic material cast therearound, said elastic material fully enclosing the spring windings of the coil spring.

13. The jolting device according to claim 11, wherein a hollow space is arranged internally of the at least one coil spring, said hollow space extending along the coil spring axis and being open on both end sides of the at least one coil spring.

14. The jolting device according to claim 1, wherein the at least one coil spring comprises a plurality of coil springs.

15. The jolting device according to claim 1, wherein the fastening assembly comprises four coil springs.

16. The jolting device according to claim 15, wherein the coil springs are surrounded by an elastic material cast around the coil springs to form a one-piece configuration therewith.

17. The jolting device according to claim 15, wherein the ends of the coil springs are connected to end-side fastening plates and these fastening plates are provided with at least one opening between the connecting sites of the coil springs and the fastening plates.

18. The jolting device according to claim 17, wherein said at least one opening has a size at least large enough to allow an object which has passed between two adjacent coil springs and has entered an inner space between the coil springs, to leave the inner space again via said opening.

19. A self-propelling slip-form paver, provided with a jolting device according to claim 1.

* * * * *